United States Patent [19]

Christensen et al.

[11] 4,099,285

[45] Jul. 11, 1978

[54] HIGH LIFT SURFACE MAINTENANCE MACHINE

[75] Inventors: Bryan L. Christensen, Bloomington; William J. Sampson, Osseo; Ronald L. Brogger, Minneapolis; Jeffrey A. Lee, Crystal, all of Minn.

[73] Assignee: Tennant Company, Minneapolis, Minn.

[21] Appl. No.: 774,981

[22] Filed: Mar. 7, 1977

[51] Int. Cl.[2] ..... E01H 1/04

[52] U.S. Cl. ..... 15/83; 298/23 R; 298/23 F

[58] Field of Search ..... 15/83–87, 15/340; 298/23 R, 23 F

[56] References Cited

U.S. PATENT DOCUMENTS

| | | | |
|---|---|---|---|
| 1,735,065 | 11/1929 | Walsh et al. | 298/23 F |
| 2,614,279 | 10/1952 | Mott | 15/83 |
| 2,829,391 | 4/1958 | Swanson et al. | 15/83 |
| 2,917,761 | 12/1959 | Burgdorff | 15/84 |
| 3,312,992 | 4/1967 | Schmidt et al. | 15/83 |

*Primary Examiner*—Edward L. Roberts
*Attorney, Agent, or Firm*—Clayton R. Johnson

[57] ABSTRACT

A surface maintenance machine that includes a powered vehicle having a rotary tool in a tool enclosure to direct debris from the surface through an enclosure outlet, a debris hopper having a debris inlet locatable adjacent the enclosure outlet, and a discharge opening remote from the hopper inlet, a hingedly mounted door for closing the discharge opening, lift arms mounted on the vehicle for mounting the hopper for pivotable movement relative thereto, supporting the hopper in a debris collecting position, and selectively elevating the hopper from a street level position to a high dump position, control arms and piston cylinder combinations to control the pivoting of the hopper as it is moved between its street level and high dump positions, the piston cylinder combinations being operated from a retracted condition to an extended condition for pivoting the hopper to a dumping position in either the street level position or the high dump position, latches mounted on the hopper that are operated through the hopper pivoting to a dumping position to release their latching engagement with the door, and a door holder assembly which upon the door swinging open as the hopper is moved to a dumping position is resiliently operated to maintain a sufficient minimum spacing of the door from the discharge opening and that upon the piston cylinder combinations being substantially fully retracted is operated to release the door and permit the door swinging under gravity to a closed position with sufficient force to insure the door is latched in a closed position, the door holder assembly being operated to permit the door swinging closed by a cam surface on the adjacent control arm.

20 Claims, 11 Drawing Figures

HIGH LIFT SURFACE MAINTENANCE MACHINE

BACKGROUND OF THE INVENTION

A surface maintenance machine having a debris hopper that can be dumped in either a street level position or a high lift position.

In U.S. Pat. No. 3,312,992 there is disclosed a street sweeper having a hopper that can be dumped in either a street level or a high dump position, hooks being provided on the lift arms that release their latching engagement with the hopper doors lugs as the hopper is pivoted to a dumping position. However with such structure the lower edge of the discharge door is at a substantial higher elevation than the hopper bottom wall which results in the hopper having to be turned through a relatively large angle to be completely emptied. Additionally to prevent debris in the hopper moving toward the debris inlet as the hopper is being elevated, the control for the dump cylinder also has to be operated. This can result in the door being released to open prior to the hopper being moved to its maximum elevated position.

It is old to provide automatic latch release mechanism for discharge gates on dump trucks, see for example U.S. Pat. Nos. 1,495,385 and 2,437,890. However such mechanism is not suitable for hoppers mounted on lift arms of sweepers wherein the hopper is pivoted relative the arms as the hopper is moved to a substantially elevated position and it is desired to maintain the discharge door latched while pivoting the hopper so debris does not slide toward the end of the hopper opposite the discharge door.

In order to provide improved mechanism for elevating a hopper of a surface maintenance machine and retaining the discharge door in a latched condition until the hopper is to be dumped and automatically release the latch as the hopper is pivoted to a dumping position, this invention has been made.

SUMMARY OF THE INVENTION

A street sweeping machine having a debris hopper mounted on lift arms for movement thereby between a street level debris collecting position and an elevated dumping position, and for movement relative the lift arms as the hopper is moved between said positions, a door hinge mounted on the hopper to close the hopper discharge opening, control arms and piston cylinder combinations for controlling the pivotal movement of the hopper relative the lift arms, and latch mechanism mounted on the hopper and operated by pivoting the hopper to a dumping position for releasing the door to move to a debris discharge position.

One of the objects of this invention is to provide new and novel means for elevating a hopper of a street maintenance machine and releasably retain the hopper discharge door in a closed position. Another object of this invention is to provide new and novel automatically operated means for latchingly retaining a surface maintenance machine hopper door in a latched condition and to automatically release the door to open when the hopper is pivoted to a discharge position. A further object of this invention is to provide for latching a hopper door in a closed position, new and novel latch means on the hopper that is operatively connected to the structure for controlling the pivotal movement of the hopper as the hopper is elevated from street level by lift arms on a surface maintenance machine that includes the hopper.

A still further object of this invention is to provide new and novel means on a surface maintenance machine hopper for retaining the discharge door open until the hopper has at least substantially returned to its non-dumping position and then release the door to allow the door to close. In furtherance of the last mentioned object, it is another object of this invention to mount the door for movement under gravity to a closed position and provide new and novel means for automatically latchingly engaging and retaining the door in a closed position after the door has been released to allow the door to close.

Figure 1:
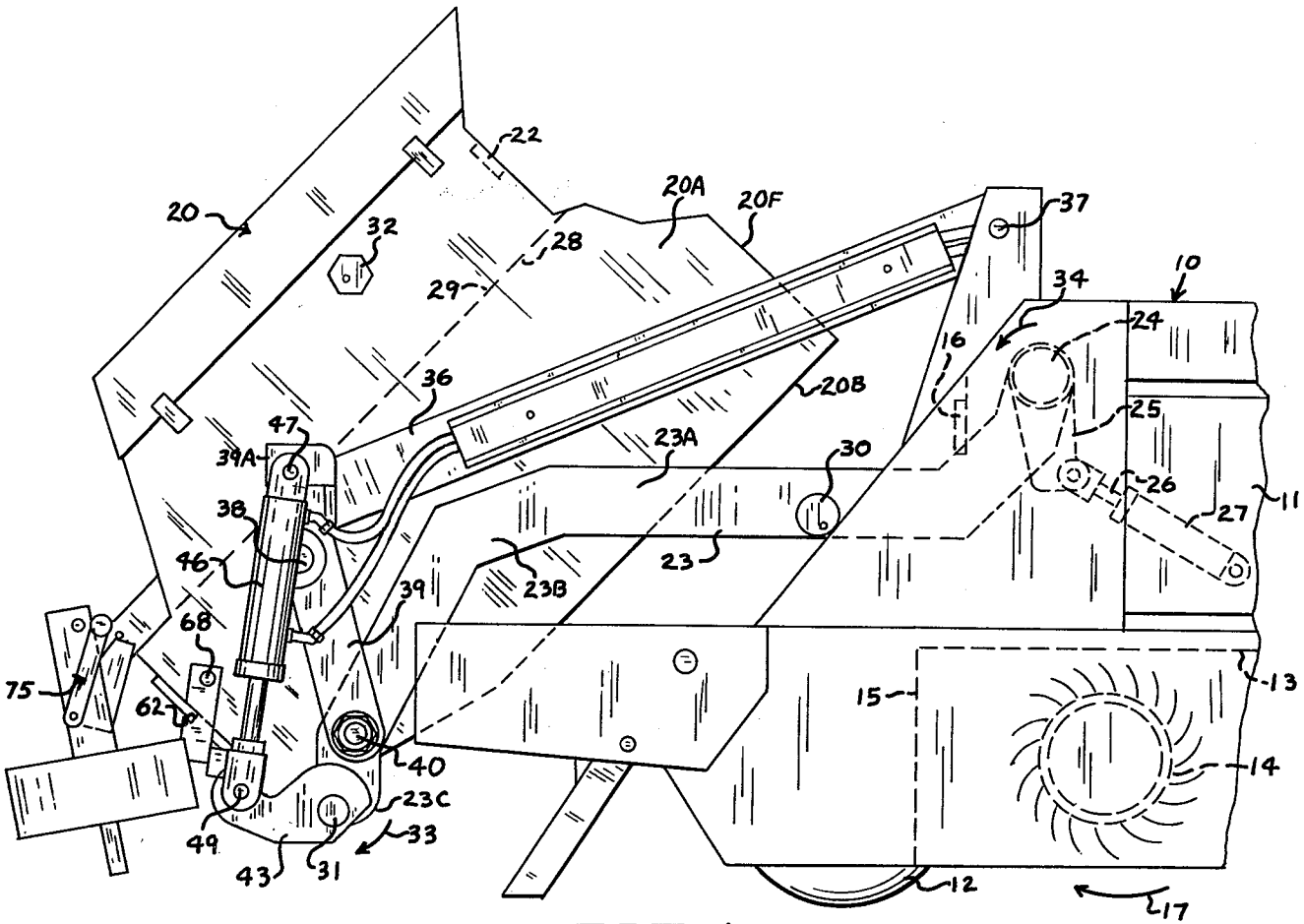
FIG. 1 is a fragmentary side view of the surface maintenance machine of this invention that has the hopper thereof in a street level dumping position.

Referring now to the drawings and in particular to FIG. 1, the street maintenance machine of this invention, generally designated 10, includes the frame 11 that is mounted on transversely spaced front support idle wheels 12 and has a rear drive and steering wheel or wheels (not shown). An engine (not shown) is mounted on the frame which serves to power the vehicle to supply power to the various power operated components. On the frame 11 there is provided a transverse open bottom housing or enclosure 13 which serves to contain the cylindrical brush 14 that is mounted on radius rods (not shown). The brush is driven by a conventional structure to rotate in the direction of the arrow 17 to direct raised material through the sweeping enclosure outlet 15 and into the inlet **20*f* of the hopper, generally designated 20**.

Other than for differences set forth hereinafter, the hopper is basically of the construction disclosed in U.S. Pat. No. 3,189,931.

That is, the hopper includes a port 22 that opens to the upper filter compartment 28 thereof, the port 22 mating with the suction port 16 on the vehicle frame when the hopper is in a datum sweeping condition. The debris compartment 29 is located vertically beneath the filter compartment to have its inlet 20*f* open to the brush enclosure outlet 15.

For supporting the hopper in a street level sweeping position and moving the hopper between the street level sweeping position and an elevated position, the vehicle is provided with transversely spaced lift arms 23 that at their rear ends are secured to a pivot shaft 24 to rotate therewith. The shaft 24 is pivotally mounted on the frame and is provided with a crank 25 which is pivotally connected to the piston rod 26 of the cylinder 27 which in turn is pivotally mounted on the frame. An eccentrically mounted stop 30 is provided on the generally horizontal rear position 23*a* of each lift arm to abut against the frame for limiting the hopper lowering movement (direction of the arrows 34) about the pivot axis of pivot shaft 24. Each lift arm has an intermediate portion 23*b* that in a lift arm datum position extends forwardly and downwardly, while the lower front end portion 23*c* pivotally mounts a hopper pivot 31. The hopper pivots 31 are fixed to the opposite hopper side walls 20*a* adjacent the front lower corners thereof to rotate therewith. Eccentrically mounted stops 32 are mounted on the hopper side walls to limit the pivotal movement of the hopper about the pivot axis of pivots 31 in the direction of the arrow 33; the stops 32 being abuttable against the lift arms to limit the hopper pivotal movement in the last mentioned direction.

For each side of the machine, a control arm pivot 37 is provided on the frame above and a slight distance forward of the axis of the pivot shaft 24; the control arm pivots pivotally mounting the rear end portions of the control arms 36. The forward end portion of the control arms are pivotally connected at 38 to the upper intermediate parts of the link arms 39, the lower ends of the link arms being pivotally connected at 40 to the lift arms. The pivot axis of pivots 40 are slightly rearwardly and above the pivot axis of the pivots 31 when the lift arms are in their datum position. It is to be noted that the pivot axis of shaft 24 is parallel to the pivot axes of pivots 31, 37, 38 and 40.

To pivot the hopper between a position that its stops 32 abut against the lift arms and a dumping position, to each of the pivots 31 there is keyed one end of a crank arm 43 that when the hopper is in its datum sweeping position extends forwardly of the pivots 31. The end portions of the crank arms remote from pivots 31 mount pivot members 44 which in turn pivotally attach the piston rods 45 of the piston cylinder combinations 45, 46 thereto on the respective side of the hopper. The clevis ends of the cylinders 46 are pivotally connected at 47 to an upper depending flange part 39*a* of the adjacent link arm 39. The flange part of each link arm mounts its pivot 47 to be more remote from pivot 40 than pivot 38. The pivot axis of the various pivots and the lengths of the arms 39, 23, 36, 43 and the piston cylinder combinations 45, 46 in their retracted conditions are such that as the hopper is moved from its datum street level debris collecting position to its elevated position the hopper bottom wall 20*b* is moved from a generally horizontal extending condition to a condition that the bottom wall extends upwardly and rearwardly at an angle of about 30° to the horizontal. This helps minimize debris discharging through the hopper inlet. The hopper may be pivoted in the direction opposite arrow 33 about the pivot axis of pivots 31 from its datum street level debris collecting position, or its datum maximum elevated non-dumping position, to a dumping position by applying fluid under pressure to the upper ends of the cylinders 46 which results in the piston rods being extended to rotate pivots 31 and the hopper in a dumping direction.

For discharging material from the hopper, the lower front wall portion 20*c* of the hopper is provided with a forwardly extending rectangular perimetric flange 50 that defines the generally rectangular discharge opening 52. A gasket 51 is mounted on wall portion 20*c* to surround the flange 50. Mounted on the forward wall portion 20*d* of the hopper in transverse relationship to extend forwardly and above wall portion 20*c* are a pair of brackets 53, the upper ends of hinged channels 54 being pivotally connected to the front parts of the brackets by pivots 55. The lower ends of the hinged channels mount a door 56 that has a rearwardly extending perimetric flange 56*a* for abutting against the gasket 51 to close the hopper discharge opening. A bumper 42 is mounted on the door to move therewith. When the hopper is in its datum debris collecting position, the front edge of the perimetric flange is substantially in a vertical plane while the center of gravity of the combination of the door and bumper is located sufficiently forwardly of the pivot axis of the pivots 55 whereby through gravitational force the door is retained in a closed condition abutting against gasket 51. If no bumper is provided, the center of gravity of the door is located so that the door will close as above indicated. The upper edge of the door is located a substantial distance below the hinge pivots 55.

For locking the door in a closed condition and to permit the opening thereof when the hopper is to be dumped, the door at each side is provided with a transversely extending stud 60 that is movable into the latch slot 62 of the adjacent latch 61. The rear part of each latch is pivotally connected at 68 to the adjacent side wall of the hopper, the pivots 68 being located rearwardly of and at a lower elevation than the pivots 55 when the hopper is in its debris collecting position. On each pivot 68 there is mounted a torsion spring 63 to act against the hopper and the latch for resiliently urging the latch to pivot in the direction of the arrow 69 to a latching position, the pivotal movement of the latch in the aforementioned direction being limited by the adjacent stop pin 64 that is mounted on the hopper. To move each latch between its latching position and its latch release position relative the respective stud, there is provided a chain 65 that has one end to attach by a pin 66 to the end of the latch remote from the latch pivot 68. The opposite end of each chain is connected to an eye bolt 67 which in turn is secured to a portion of the adjacent link arm about midway between pivots 38 and 40. As long as the piston rods 45 are in their retracted conditions, the chains 65 are in their slackened condition whereby the latches remain in a latching position, and the latches abut against the respective stop pin 64. However, as the piston rods are moved to their extended position to pivot the hopper toward a dumping position, the latch pivots 68 are moved to be progressively more remote from the link arms 39 and eye bolts 67, as are the ends of the latches to which the chain pins 66 are connected. As a result the slack in the chains is decreased. When the chain pins 66 are prevented from moving further away from the eye bolts by there being no slack in the chains, upon further rotation of the hopper in the direction opposite arrows 33 the hopper moves relative to latches so that the door studs 60 are pivoted out of the latch slots. When the door studs are pivoted out of the latch slots the front edge of flange 50 defining the discharge opening is located in a plane that extends upwardly in a forwardly direction and since the door pivots 55 are a substantial distance forwardly of the studs and the center of gravity of the door and bumper combination, the door under gravity swings to an open condition to permit material in the hopper to discharge through the discharge opening.

The latch has an edge 61*a* sloped so that when the latch is in its latching position and the door is moved from an open position that the adjacent door stud does not engage the latch to a closed position, the stud engages edge 61*a* to cam the latch to a release position. Upon the stud moving over the latch slot, the latch is resiliently returned to its latching position to hold the door closed.

To retain the door in a sufficiently open condition such that when the hopper is returned to the piston rod retracted position the door will swing shut to be latchingly retained in a door closed position by the latches, there is provided cam operated door holder mechanism, generally designated 75 adjacent one side of the hopper. As shown in FIGS. 6, 7, 10 and 11, one hinged channel 54 pivotally mounts a transverse pivot shaft 76 to extend outwardly thereof toward the adjacent control arm. The intermediate part of the pivot shaft has one end of a stop arm 77 secured thereto to rotate therewith, one end of a spring 78 being connected to the stop arm and the opposite end being attached to the channel at 79 to, through the stop arm, resiliently urge the shaft to rotate in the direction of the arrow 80 about the axis of shaft 76. An adjustment screw 81 is threaded into the stop arm and is abuttable adjacent the door to limit the pivotal movement of the stop arm in the aforementioned direction. A stop 82 is mounted on bracket 53 to extend outwardly thereof for abutting against edge 77*a* of the stop arm that is remote from shaft 76. Edge 77*a* in abutting against stop 82 holds the door open. In a hopper street level datum position the stop is located vertically between the axes of hinge pins 55 and the pivotal axis of shaft 76 and rearwardly of the plane of the axis of members 76, 55.

The end of the pivot shaft adjacent the control arm has the radially inner end of the cam arm 84 welded thereto, the cam arm extending outwardly from the shaft at about the same direction that the stop arm extends outwardly therefrom. The outer end of the cam arm mounts a cam roller 85 in a position that the cam roller is abuttable against the cam surface 86 of the upper front portion of the adjacent control arm. When the hopper is in its datum debris collecting position the elongated edge 77*b* abuts against stop 82, the stop arm being resiliently retained in such a position. At this time the stop arm and cam arm extend generally vertically out of engagement with the hopper and control arm. As long as the piston rods 46 are retained in their retracted conditions, the stop arm and the cam arm are retained in the above mentioned relationship with the cam follower roller out of contact with the control arm. However, when the piston rods 46 are moved to their extended condition, the hopper is pivoted such that the cam roller moves further away from the cam surface 86. After the hopper has pivoted in the direction opposite arrows 33 sufficiently that the door studs move out of the latch slots, the door under the action of gravity swings to an open condition to be more remotely spaced from the perimetric flange defining the discharge opening; and as the door swings open, shaft 76 moves further away from stop 82. Since the stop arm is resiliently urged to pivot in the direction of arrow 80, as the door opens the stop arm is moved such that the stop pin 82 abuts against parts of the edge 77*b* that are progressively closer to edge 77*a* and the cam roller is moved toward or into abutting engagement with cam surface 86 of the control arm. If the cam roller abuts against surface 86, the control arm will limit the pivotal movement of shaft 76 and thereby that of the stop arm. However, upon the piston rods 45 being extended sufficiently to pivot the hopper that the door in a generally vertically extending condition has moved relative the hopper that edge 77 is out of engagement with stop 82, spring 78 moves the stop arm such that edge 77*a* is located between shaft 76 and stop 82; the cam roller not abutting against the cam surface 86 to preclude this movement of the stop arm. The adjustment screw 81 is set to abut against the door to limit the pivotal movement of the stop arm in the direction of arrow 80 to a position relative channel 54 that edge 77*a* will abut against the stop even though the hopper is pivoted and/or the door swings away from the hopper outlet sufficiently to move the stop arm out of conduct with the stop and then the door swings toward a closed condition. Thus, as long as the adjustment screw abuts against the door and cam roller remains out of contact with the control arm, the stop arm will preclude the door moving relative the hopper to a position that the spacing of the lower edge of the door and the lower edge of the hopper outlet is less than a minimum preselected spacing from one another. Thus, if the stop arm pivots to a position that the adjustment screw abuts against the door with edge 77*b* out of contact with the stop and edge 77*a* spaced from the stop, then upon either the door swinging about its pivots in the direction of arrow 100, and/or upon the hopper being moved away from its dumping position, the door will move relative to the hopper to a position the stop arm edge 77*a* moves into abutting engagement with the stop to maintain at least the minimum spacing between the lower edge of the door and the lower front edge of the perimetric flange 50, until the hopper has been pivoted to a position that the latches are again abutting against the latch stop 64. With reference thereto, pivoting the hopper toward its non-dumping position moves pins 66 to be closer to the eye bolts and so the springs 63 move the latches toward their latching position until the latches abut against stops 64. Now upon further retraction of the dump cylinder piston rods the hopper pivots to a position that the cam roller moves into abutting engagement with the cam surface 86. Still further retraction of the dump cylinder piston rods result in the cam roller moving along the cam surface which forces the cam arm to pivot the pivot shaft 76 in the direction opposite arrow 80. This results in the cam arm being pivoted in a direction opposite arrow 80 to move edge 77*a* above the plane of the central axes of shaft 76 and stop pin 82 and since at this time the plane of the front edge of perimetric flange 50 is substantially vertical and the plane of the door extends downwardly and forwardly at a substantial angle from the perimetric flange plane and the door is substantially spaced from the flange, the door swings shut with sufficient force that the latch studs force the latches to pivot against the action of their springs to permit the studs to enter into the latch slots and then the latches are resiliently returned to their latching position to hold the door in a latched condition. That is, the holder assembly 75 retains the door in a sufficiently open condition to insure that upon the door moving to a closed position it will move with a sufficient force to insure that its latch studs are latchingly engaged by the latches to retain the door in a closed position. At the time edge 77*b* is moved above the plane of the central axes of shaft 76 and the stop pin 82 the initial closing action of the door results in edge 77*b* abutting against the stop pin and as the door moves further toward a closed position, the pin abuts against parts of edge 77*b* that are progressively further from edge 77*a*. Also, since this closing movement results in the plane of the central axes of shaft 76 and pins 55 moving closer to the stop, the stop arm is forced to pivot in the direction opposite arrow 80 against the urging of spring 78. This pivotal movement of arm 77 results in the cam arm pivoting to move the cam roller out of contact with the control arm. Further, it is believed it is apparent from the above that the aforementioned action of the holder assembly is the same whether the hopper is moved to a dumping position at a street level position, or at its maximum elevated position, or at a position intermediate to the street level and maximum elevated positions.

To be mentioned is that the stop 82 can be mounted on the hopper by a bracket separate from the bracket 53, or by extending the shaft 76 outwardly of the channel 54 on the opposite side thereof from the cam arm and mounting the stop arm on the extended part of the shaft in a different angular relationship than shown, the stop arm can abut against the hopper to function in the manner above set forth. If the stop arm is mounted in this different angular relationship it is preferred that a roller be mounted on the stop arm remote from shaft 76 to abut against the hopper in place of the stop arm and be rotatable about an axis parallel to the central axis of the shaft. However, it is preferred to use a stop 82 that can be sheared off by the stop arm in the event the sweeper should be propelled forwardly with the door being retained in an opened condition by the stop arm and the door comes into forcible contact with another object.

Figure 2:
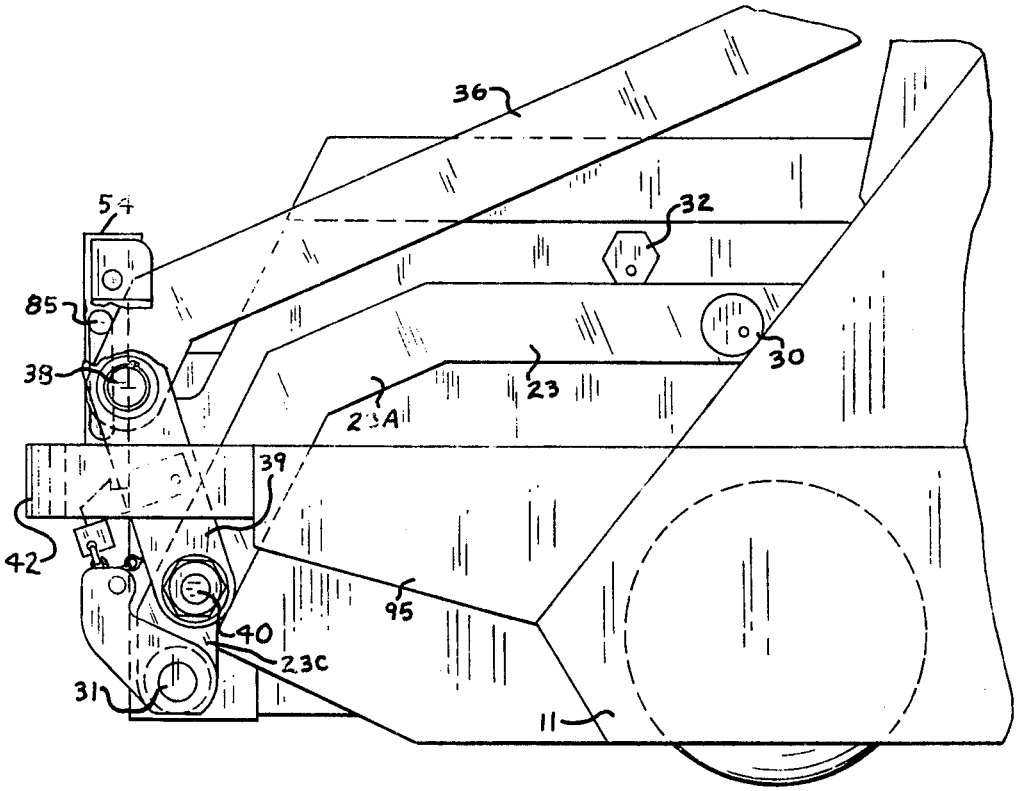
FIG. 2 is a fragmentary side view of the structure of FIG. 1 showing the hopper in a datum sweeping position; (the hopper dumping piston cylinder combination not being shown).
Figure 3:
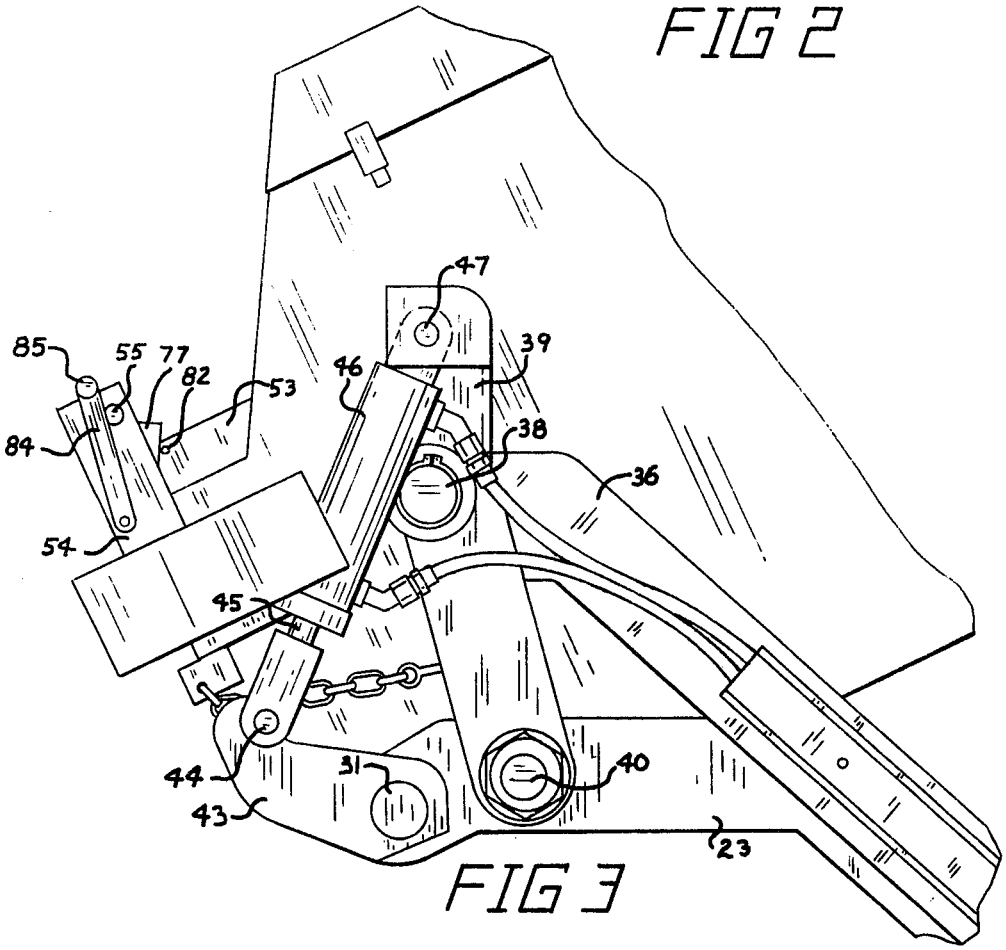
FIG. 3 is a fragmentary side view showing the hopper in an elevated position, but prior to being tilted to a dumping position.
Figure 4:
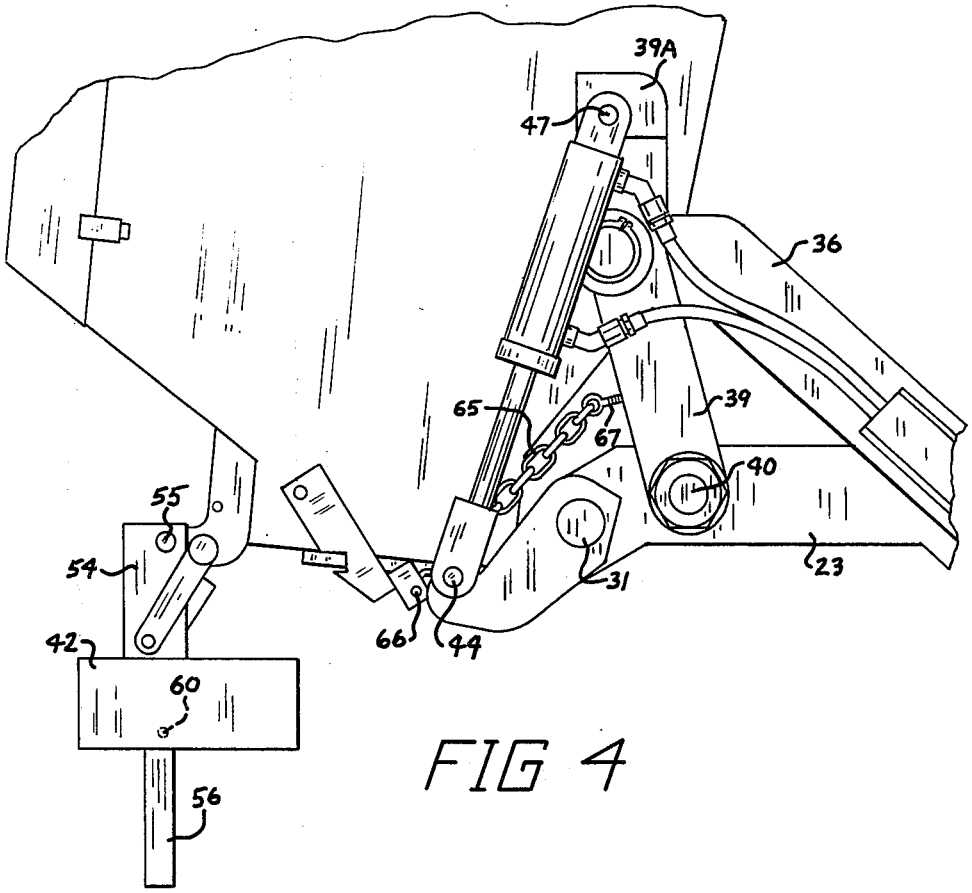
FIG. 4 is a fragmentary side view of the structure of FIG. 3 other than the hopper is in a hopper dumping position.
Figure 5:
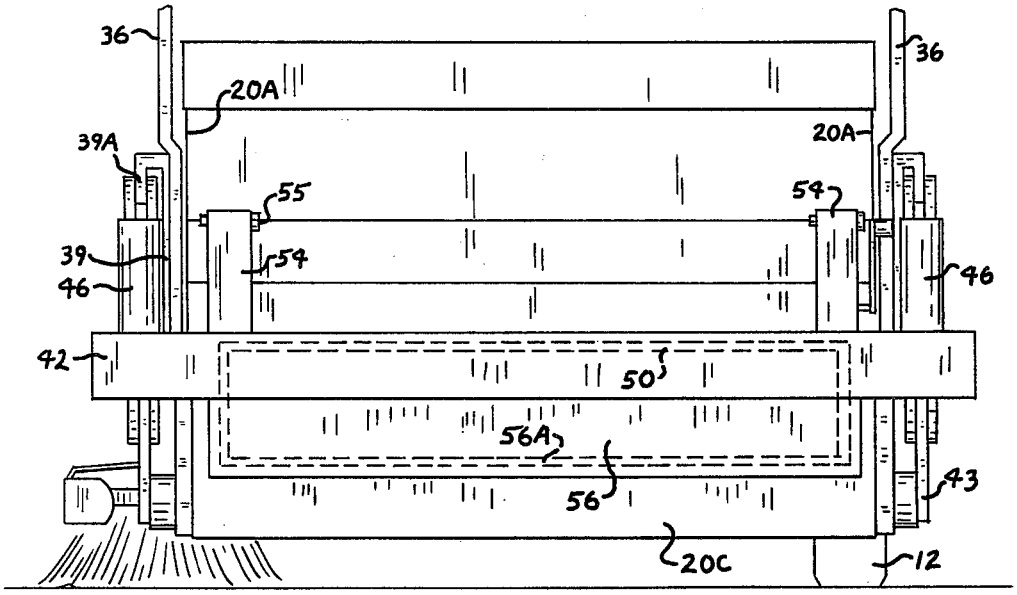
FIG. 5 is a fragmentary front view of the apparatus of this invention.
Figure 7:
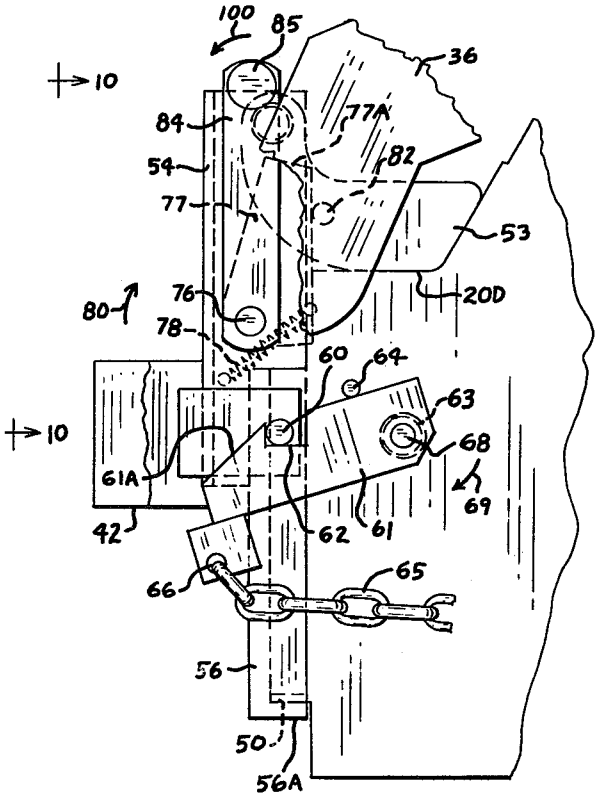
FIG. 7 is a fragmentary side view showing the hopper door in a locked condition, part of the front bumper being broken away.
Figure 6:
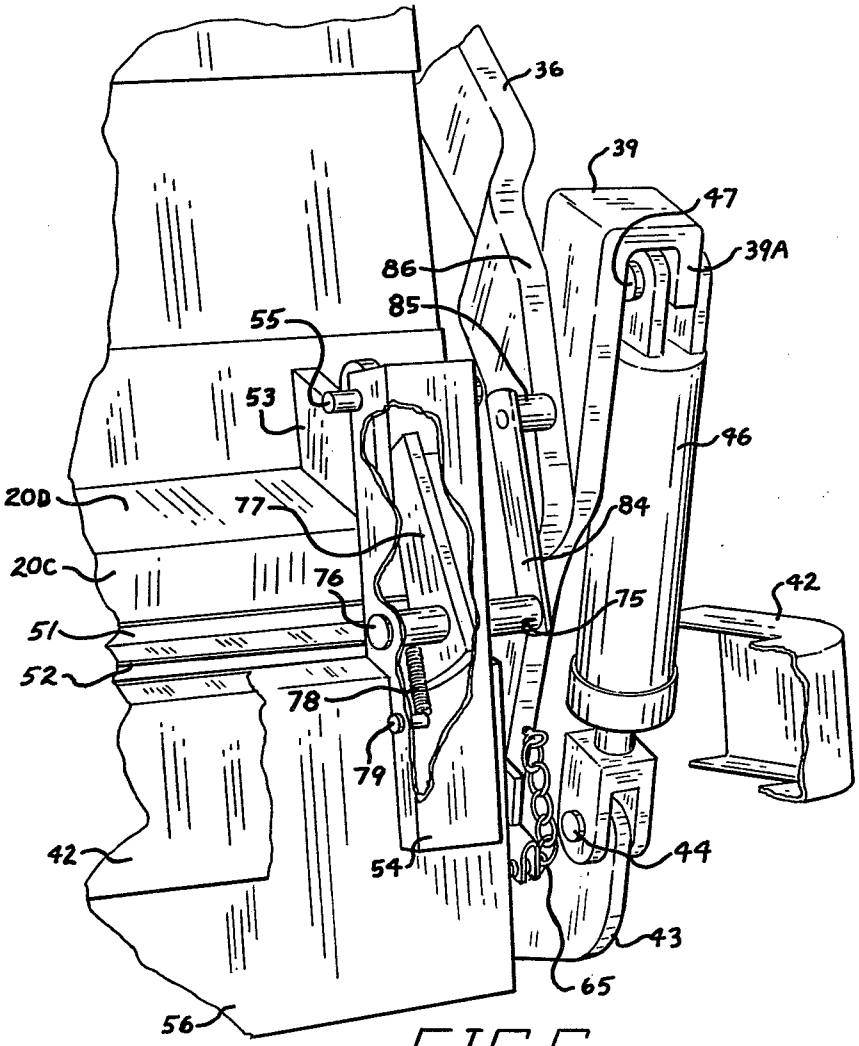
FIG. 6 is an enlarged perspective view of the front corner of the hopper in a street level position, just after the hopper has been tilted sufficiently for the door to swing open, part of the bumper being broken away.
Figure 9:
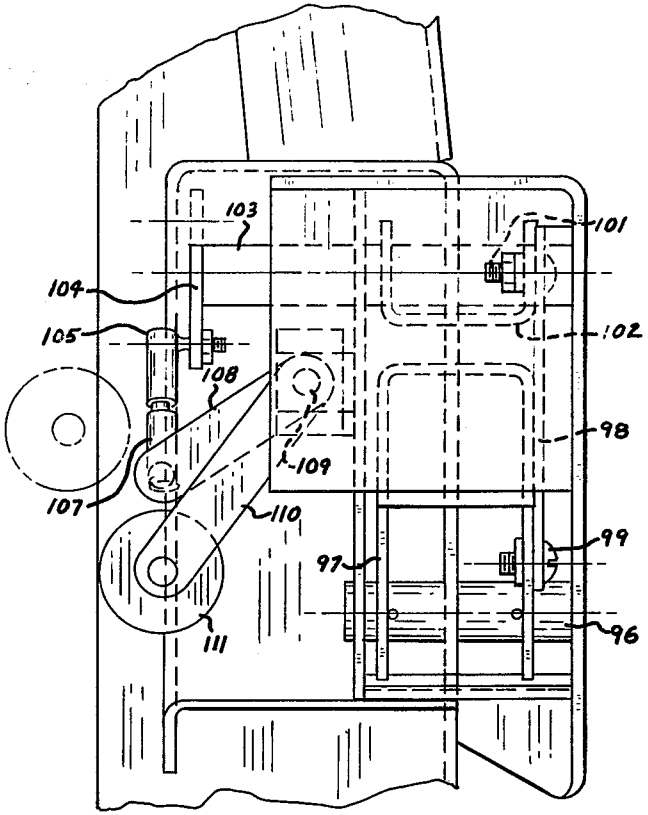
FIG. 9 is a fragmentary cross-sectional view of the structure of FIG. 8 other than the leg is shown in a retracted condition.
Figure 8:
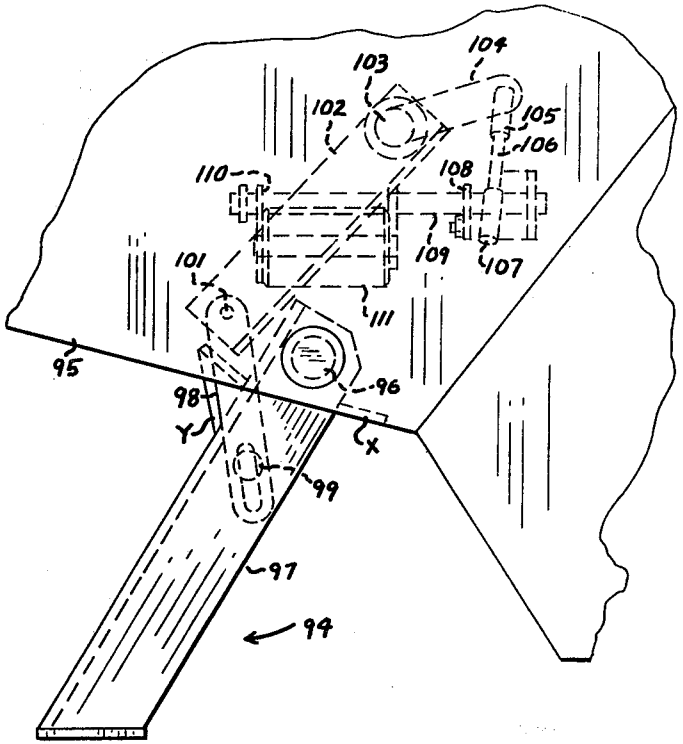
FIG. 8 is a fragmentary side view showing the stabilizing leg and linkage in a leg down condition.
Figure 10:
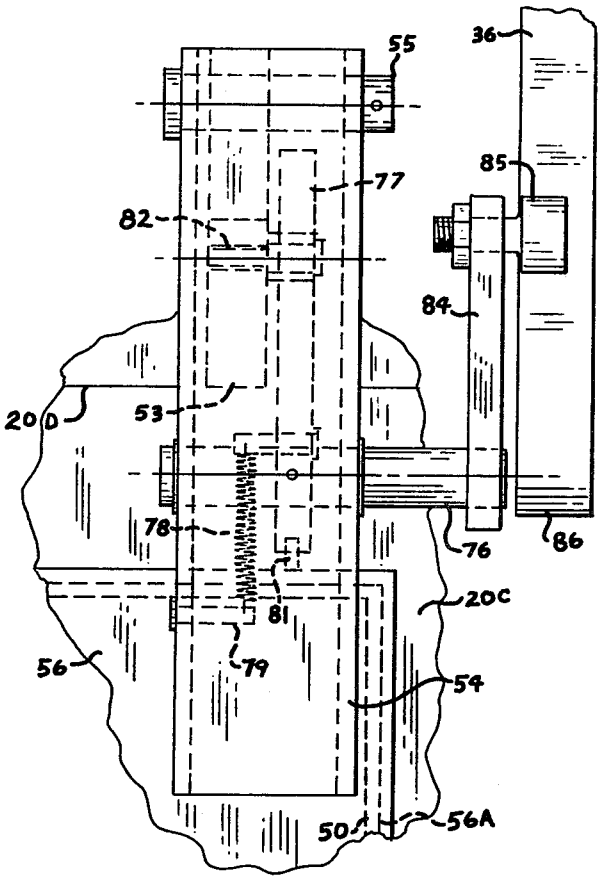
FIG. 10 is an enlarged fragmentary front view of the door holder mechanism, said view being generally taken along the line and in the direction of the arrows 10—10 of FIG. 7.
Figure 11:
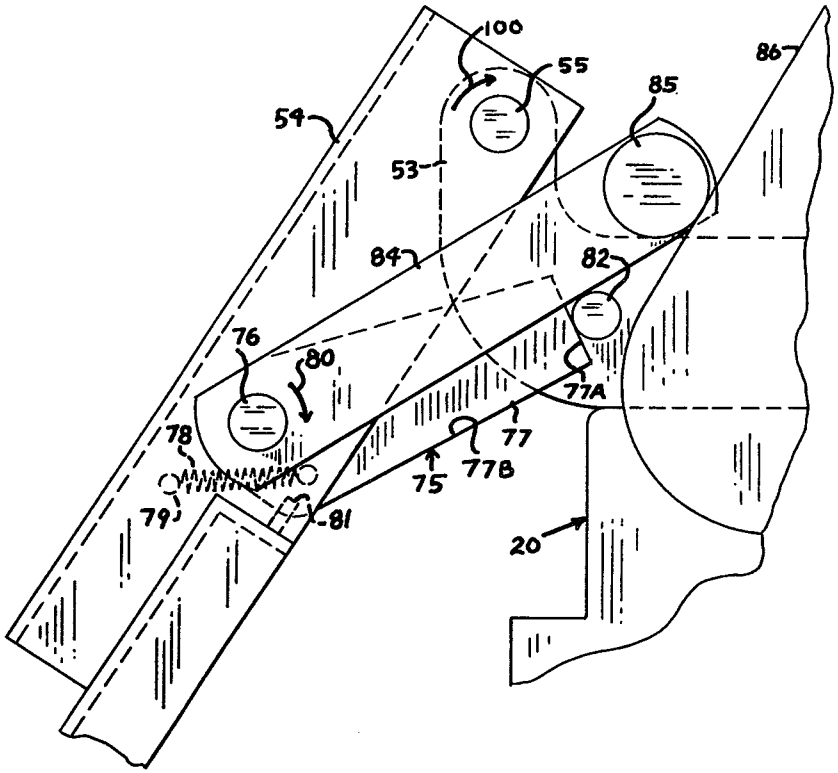
FIG. 11 is a side view of the structure of FIG. 10, other than it shows the door being held in an open condition.

To stabilize the vehicle when the hopper is in high lift position, the frame at one side of the hopper is provided with a forward extension 95 that extends forwardly along the side of the hopper (see FIGS. 2, 8 and 9). Since the stabilizing assembly, generally designated 94, that is mounted on the extension 95 could be utilized on either the left or right side and would be identical except that one is a left hand assembly and the other a right hand assembly, only one of such assembly will be described. The stabilizing leg assembly includes a leg 97 that at one end is pivotally connected by transverse pivot 96 to extension 95, the other end of the leg being a foot end that is abuttable against the surface being cleaned. A lost motion link 98 at one end is pivotaly connected to the leg 97 by a transverse pivot 99 being extended through an elongated slot in the link and the opposite end is pivotally connected at 101 to arm 102 which in turn is welded to transverse pivot 103 that is pivotally mounted by the extension. A radial arm 104 is keyed to pivot 103 and has an opposite end connected by a spherical bearing 105 to a link 106. The opposite end of the link 106 is pivotally connected by its spherical bearing 107 to a link 108 that is keyed to a longitudinal shaft 109. The shaft 109 is rotatably mounted by the extension and has radially extending arms 110 keyed thereto. The outer ends of the arms mount a cam roller 111 in a position to abut against the bottom wall of the hopper when the hopper is returned to its debris collecting position. The solid line showing of roller 111 in FIG. 9 is its position when the hopper is in its street level datum position while the dotted line showing is the roller position after the hopper has been elevated or has been moved toward its dumping position, the dotted and solid line showings being the limited position of the roller. The hopper in returning to its debris collecting position abuts against the roller to result in the shaft 109 pivoting and the pivotal movement of the shaft through the aforementioned links forcing the leg 97 to move about its pivot 96 to an elevated position and to be retained in the elevated position as long as the hopper is in its debris collecting position. When the hopper is moved a short distance above its debris collecting position, the hopper is free to move and does move upwardly whereby the leg 97, due to the weight thereof, moves the linkage to in turn move the roller to an elevated condition (dotted line position of the roller in FIG. 9). The leg in moving downward abuts against stop *x* and arm 102 then drops behind projection *y* which is welded to leg 97. This locks leg 97 in the downward position within close proximity of the floor. Substantial tipping movement of the vehicle while the hopper is no longer in its debris collecting position is thus prevented when leg 97 abuts against the floor.

What is claimed is:

1. A surface maintenance machine comprising a vehicle having a frame, means on the frame defining a downwardly opening sweeping enclosure that has a debris outlet, a debris hopper having a debris inlet and a debris outlet remote from the debris inlet, powered arm means mounted on the frame for supporting the hopper in a street level position so that the debris inlet is adjacent the enclosure outlet and mounting the hopper for pivotal movement relative thereto, means for selectively pivoting the hopper relative the arms means between a dumping position relative the arm means for discharging debris through the hopper discharge outlet, and a non-dumping position, and controlling the pivotal positions of the hopper relative the arm means, a door, means for mounting the door on the hopper for movement under gravity from a position closing the hopper outlet when the hopper is in its non-dumping position to a position permitting debris discharge through the hopper outlet when the hopper is in its dumping position, a lug on the door, operable latch means mounted on the hopper for movement between a latching position latchingly engaging the lug to retain the door closed and a lug release position, and means connected to the control means for operating the latch means to its release position as the control means pivots the hopper to its dumping position, the hopper having a parimetric flange portion defining the hopper outlet, and door holder means for retaining the door in its open position in substantial spaced relationship to said hopper portion after the control means has operated the latch means to its release position and until the control means has operated the hopper back to adjacent its non-dumping position, and thence release the door to allow it to close.

2. The apparatus of claim 1 further characterized in that the door holder means includes a pivot shaft mounted on the means mounting the door for movement, an abutment member mounted on the shaft to pivot therewith between a first position to hold the door open and a second position spaced from its first position that will permit the door to close, means for resiliently urging the shaft to pivot the abutment member to its first position, and means mounted on the shaft and operable by the control means pivoting the hopper to move the abutment member to its second position after the hopper has been moved from its dumping position to closely adjacent the non-dumping position, the hopper having means thereon for engaging the abutment member in its first position to hold the door open.

3. A surface maintenance maching comprising a vehicle having a frame, means on the frame defining a downwardly opening sweeping enclosure that has a debris outlet, a debris hopper having a debris inlet, a debris outlet remote from the debris inlet and transversely opposite pivots, power operated arm means for moving the hopper between a street level position and an elevated position, said arm means having first end portions pivotally mounting the hopper pivots for movement therewith and pivotal movement relative thereto, means for selectively pivoting the hopper relative the arm means between a hopper dumping position and a hopper non-dumping position and controlling the pivotal position of the hopper relative the arm means, a door, means for mounting the door on the hopper for movement under gravity from a position closing the hopper outlet when the hopper is in its non-dumping position to a position permitting debris discharge through the hopper outlet when the hopper is in its dumping position, a lug on the door, operable latch means mounted on the hopper for movement between a latching position latchingly engaging the lug to retain the door closed and a lug release position, and means connected to the control means for operating the latch means to its release position as the control means pivots the hopper to its dumping position, the control means including a link arm, means for pivotally connecting the link arm to the arm means, a control arm having one end portion pivotally connected to the link arm remote from the means for pivotally connecting the link arm to the arm means, and an opposite end portion pivotally mounted on the frame, and means connected between the link arm and the hopper for selectively pivoting the hopper between a dumping position and a non-dumping position.

4. The apparatus of claim 3 further characterized in that the means connected between the hopper and the link arm includes a crank arm connected to one of the hopper pivots for pivoting the hopper pivot it is connected to and piston cylinder means pivotally connected to the link arm and to the crank arm for operating the crank arm to pivot the hopper pivot it is connected to for pivoting the hopper between its dumping position and its non-dumping position.

5. The apparatus of claim 3 further characterized in that the means for operating the latch means is connected to the link arm.

6. The apparatus of claim 3 further characterized in that the latch means includes a latch, means for mounting the latch on the hopper for pivotal movement relative to the hopper, and means for resiliently retaining the latch in a latching position while permitting the latch pivoting to a latch release position and that the means for operating the latch means includes means connecting the latch to the link arm for pivoting the latch relative the hopper to the latch release position.

7. The apparatus of claim 6 further characterized in that the hopper has a perimetric portion defining the hopper debris outlet, that each of the door and the perimetric portion has a lower edge and that the door mounting means includes hinge means mounting the door for movement between its positions including an open position in which the door and perimetric portion lower edges are spaced at least a preselected distance from one another, and door holder means cooperating with the hinge means for retaining the door in an open position that said edges are spaced at least said preselected distance after the hopper has been moved to its dumping position and permit the door moving to its closed position only after the hopper has been sufficiently moved from its dumping position toward its non-dumping position so that the door will swing under gravity to its closed position with sufficient force to move the latches from their latched position to their release position.

8. The apparatus of claim 7 further characterized in that the hopper includes hopper walls, including said permetric portion, joined together to form a debris receptacle, metric portion, joined together to form a debris receptacle, that the hinge means includes a hinge member mounted on the door to move therewith, and that the door holder means includes a stop on the hopper, a shaft pivotally mounted by the hinge member to move therewith, an abutment member mounted on the shaft to move therewith between a door holding release position and a position abutting against the stop to prevent the door moving to a closed position, means for resiliently urging the shaft to the abutment member stop abutting position, and operable means connected to the shaft for moving the shaft to the door holding release position after the latch has moved from its release position to its latching position when the hopper is being moved from its dumping to its non-dumping position.

9. The apparatus of claim 8 further characterized in that the last mentioned means includes a cam member operated by the control means.

10. A surface maintenance machine comprising a debris hopper having a debris inlet and a debris outlet, a vehicle having a frame, means mounted on the frame for moving the hopper between a debris collecting position and a debris dumping position, and means on the frame for directing debris into the hopper inlet when the hopper is in its debris collecting position, a door for closing the hopper outlet, said door and hopper outlet each having a lower edge, means mounting the door on the hopper for movement under gravity as the hopper is moved to its dumping position between an outlet closed position and an open position so that the door edge is spaced at least a preselected distance from the hopper edge, and door holder means automatically operated to a door holding position to hold the door with said edges spaced at least said preselected distance after the hopper has been moved sufficiently toward its dumping position so that said edges are spaced at least said distance, and after the hopper has been moved from its dumping position, to a release position allowing the door to move to a closed position.

11. The apparatus of claim 10 further characterized in that the door holder means includes abutment means movable between a position for retaining the door with said edges spaced at least said preselected distance after said edges have relatively moved away from one another by at least said preselected distance and a release position, and control means operated by the hopper moving means moving the hopper away from its dumping position for moving the abutment means to its release position.

12. The apparatus of claim 11 further characterized in that control means includes a pivot shaft mounted on one of the door and the door mounting means, the abutment means being mounted on the pivot shaft to move therewith.

13. The apparatus of claim 11 further characterized in that there is provided a lug mounted on the door and latch means resiliently urged to a latched position for engaging the lug to hold the door in a closed position and movable to a latch release position to permit the door opening.

14. The apparatus of claim 11 further characterized in that the means for moving the hopper includes elevating means mounted on the frame for moving the hopper to an elevated dumping position while permitting pivotal movement of the hopper relative thereto and control means for controlling the pivotal movement of the hopper relative the elevating means and selectively pivoting the hopper between a non-dumping position and a dumping position, the last mentioned control means having means for operating the means operated by the hopper moving means for moving the abutment means to its release position as the hopper is moved from its dumping position to adjacent its non-dumping position.

15. The apparatus of claim 14 further characterized in that there is provided means connecting the latch means to the said last mentioned control means for automatically moving the latch means to its release position after the hopper has been moved from its non-dumping position to its dumping position and permitting the latch means returning to its latching position prior to the abutment means moving to its door release position.

16. The apparatus of claim 14 further characterized in that the elevating means includes a lift arm having a first end portion pivotally connected to the frame and a second end portion, first pivot means for connecting the hopper to the lift arm second end portion, and that the said last mentioned control means includes a control arm having a first end portion pivotally connected to the frame and a second end portion, an elongated link arm having a first end portion and a second end portion, second pivot means for pivotally connecting the link arm first end portion to the lift arm second end portion and third pivot means for pivotally connecting the link arm second end portion to the control arm second end portion.

17. The apparatus of claim 16 further characterized in that the elevating means includes a piston cylinder combination having one end pivotally connected to the link arm and an opposite end connected to the first pivot means for selectively pivoting the first pivot means between a hopper dumping position and a hopper non-dumping position, that the first mentioned control means includes a cam member mounted on the pivot shaft to pivot therewith and that the control arm has a cam surface for moving the cam member when the hopper is pivoted from its dumping to its non-dumping position.

18. The apparatus of claim 16 further characterized in that there is provided a stabilizing leg assembly on the frame, said assembly including a stabilizing leg pivotally mounted on the frame for movement between a lowered surface engaging position to prevent the vehicle tipping when the hopper is being dumped and an elevated position and hopper actuated linkage means mounted on the frame for moving said leg to its elevated position when the hopper is moved to its debris collecting position and release the leg to move to its surface engaging position when the hopper is moved out of its debris collecting position.

19. A surface maintenance machine comprising a vehicle having a frame, means on the frame defining a downwardly opening sweeping enclosure that has a debris outlet, a debris hopper having a debris inlet and a debris outlet remote from the debris inlet, powered arm means mounted on the frame for supporting the hopper in a street level position so that the debris inlet is adjacent the enclosure outlet, the hopper having transversely opposite pivots pivotally mounted by the arm means, means for selectively pivoting the hopper relative the arms means between a dumping position relative the arm means for discharging debris through the hopper discharge outlet, and a non-dumping position, and controlling the pivotal positions of the hopper relative to the arm means, a door, means for mounting the door on the hopper for movement under gravity from a position closing the hopper outlet when the hopper is in its non-dumping position to a position permitting debris discharge through the hopper outlet when the hopper is in its dumping position, a lug on the door, operable latch means mounted on the hopper for movement between a latching position latchingly engaging the lug to retain the door closed and a lug release position, the control means including a link arm, means for pivotally connecting the link arm to the arm means, a crank arm connected to one of the hopper pivots, a piston cylinder combination pivotally connected to the crank arm remote from the one hopper pivot and pivotally connected to the link arm remote from the means pivotally connecting the link arm to the arm means, a control arm having a front end portion and a rear end portion, means for pivotally connecting the contol arm rear portion to the frame, and means for pivotally connecting the control arm front end portion to the link arm remote from the means for pivotally connecting the link arm to the arm means, and means connected to the control means for operating the latch means to its release position as the control means pivots the hopper to its dumping position, the means for operating the latch means being connected to the link arm.

20. A surface maintenance machine comprising a vehicle having a frame, means on the frame defining a downwardly opening sweeping enclosure that has a debris outlet, a debris hopper having a debris inlet, a debris outlet remote from the debris inlet and transversely opposite pivots, power operated arm means mounted on the frame for supporting the hopper in a street level position so that the hopper inlet is adjacent the enclosure outlet, said arm means having end portions mounting the hopper pivots for movement therewith and pivotal movement relative thereto, a crank arm joined to one of the hopper pivots to pivot therewith, means connected to the crank arm for controlling the pivotal position of the crank arm relative the arm means and selectively moving the hopper crank arm to pivot the hopper relative the arm means between a debris collecting position that the debris inlet is adjacent the enclosure outlet when the hopper is at the street level position and a dumping position relative the arm means for discharging debris though the hopper discharge outlet, a door, means for mounting the door on the hopper for movement under gravity from a position closing hopper outlet to a position permitting debris discharge through the hopper outlet when the hopper is moved towards its dumping position, a lug mounted on the door, movable latch means movable between a lug latching position and a lug release position and means connected between the latch means and the means for selectively moving the crank arm for moving the latch from its lug latching position to its release position as the hopper is moved to a dumping position.

* * * * *

UNITED STATES PATENT AND TRADEMARK OFFICE

CERTIFICATE OF CORRECTION

PATENT NO. : 4,099,285

DATED : July 11, 1978

INVENTOR(S) : Bryan L. Christensen, William J. Sampson, Ronald L. Brogger and Jeffrey A. Lee It is certified that error appears in the above-identified patent and that said Letters Patent are hereby corrected as shown below:

Column 10 lines 26 and 27 (Claim 8, lines 4 and 5), "metric portion, joined together to form a debris receptacle," should be deleted.

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*